US006688937B1

(12) United States Patent
Tsai

(10) Patent No.: US 6,688,937 B1
(45) Date of Patent: Feb. 10, 2004

(54) SEMI-SCALE TOY PLANE

(76) Inventor: Yu-Chi Tsai, PO Box 487, Changhua City 500 (TW)

( * ) Notice: Subject to any disclaimer, the term of this patent is extended or adjusted under 35 U.S.C. 154(b) by 36 days.

(21) Appl. No.: 09/607,940

(22) Filed: Jun. 30, 2000

(51) Int. Cl.[7] ..... A63H 27/00
(52) U.S. Cl. ..... 446/67; 446/61; 446/230
(58) Field of Search ..... 446/71, 76, 80, 446/88, 487, 488, 57, 59, 60, 62, 67, 61; 244/153, 154

(56) References Cited

U.S. PATENT DOCUMENTS 1,883,651 A * 10/1932 Ensley ..... 446/230
2,251,090 A * 7/1941 West ..... 446/67
2,864,613 A * 12/1958 Porter ..... 446/28
4,895,541 A * 1/1990 Miller ..... 446/57
5,482,489 A * 1/1996 Stone ..... 446/67

* cited by examiner

*Primary Examiner*—Derris H. Banks
*Assistant Examiner*—Bena B. Miller

(57) ABSTRACT

A semi-scale toy plane is disclosed. The fuselage is made of tetrahedral folding plates. Fuselage has a front and a rear parts. The front fuselage is an enhanced straight tube, the rear fuselage is a tetrahedral cone. Front and rear fuselages are joined by joint members. Rear fuselage and tail plane are integrally formed with a crease divided therebetween. Wing is secured to fuselage by engaging buttons to button holes. V-shaped dihedral frames are secured between wing and dihedral holders of fuselage. This invention is capable of finishing assembly in about 10 seconds without requiring a user having any glue, tool, skill or aerodynamics knowledge.

5 Claims, 13 Drawing Sheets

SEMI-SCALE TOY PLANE

FIELD OF THE INVENTION

The present invention relates to toys and more particularly to a semi-scale toy plane having the characteristics of easy assembly.

BACKGROUND OF THE INVENTION

Model planes have been popular for a long time. In the past, model plane is made of lightweight wood. Recently, model plane is mostly made of plastic material. However, the conventional design suffered from a disadvantage. For example, it usually requires a person have some aerodynamics knowledge and skill in order to assemble the components of model plane. As such, an ordinary person, especially a child, may not able to assemble a model plane in a quick and correct way. This often frustrates many people. In conclusion, the conventional model plane is a hobby not that a toy.

SUMMARY OF THE INVENTION

It is therefore an object of the present invention to provide a novel lightweight semi-scale toy plane having the advantage of quick assembly without requiring a user having any skill or aerodynamics knowledge.

To achieve the above and other objects, the present invention provides a semi-scale toy plane wherein the fuselage is made of tetrahedral folding plates, fuselage has a front and rear parts, the front fuselage is a tetrahedral straight tube for receiving rubber band, the rear fuselage is a tetrahedral cone, front and rear fuselages are joined by joint members, rear fuselage and tail plane are integrally formed with a crease divided therebetween, wing is installed to fuselage by engaging buttons to button holes, and V-shaped dihedral frames are secured between wing and fuselage.

The above and other objects, features and advantages of the present invention will become apparent from the following detailed description taken with the accompanying drawings.

DETAILED DESCRIPTION OF THE PREFERRED EMBODIMENTS

The semi-scale toy plane of the invention is made of a lightweight polystyrene paper (PSP) in replacement of conventional Balsa wood. The specific gravity of PSP is lower than that of Balsa wood, it is possible making a wing loading of $6g/dm^2$, also it is possible that the PSP material printed with a color pattern prior to being cut into fuselage plates of the invention, and has the advantages of low cost and thus are widely used in manufacturing toys. The only drawback of PSP is that it is loose. As such, it is necessary to enhance the strength of PSP by adding a few molding members and steel wires into it. As a result, a desired semi-scale PSP plate is obtained by the invention.

Above semi-scale idea means that fuselage is made as a tetrahedral tube shape or conic shape after two fuselage plates are joined. The tetrahedral shape used herein means that it consists of regular tetragon or rhomb and two diagonals which are normally crossed. The profile area of the tetrahedron is subject to design requirements. The maximum torsion of tetrahedral plate is determined by the diagonals, PSP foam density, and the thickness of plate. In an experimental data, a tetrahedral tube having a specific gravity 0.1, thickness 2 mm, and side length 20 mm can withstand 250 complete rotations of four $1.5mm^2$ rubber bands without breaking or contorting.

The fuselage of the invention is joined by two parts. The front fuselage is generally an enhanced straight tube for receiving rubber band. The rear fuselage is generally a tetrahedral cone.

The invention adopts a button hole design of installing wing and implements a V-shaped dihedral frame design. This is an improvement to prior art which typically glues components together.

Figure 1:
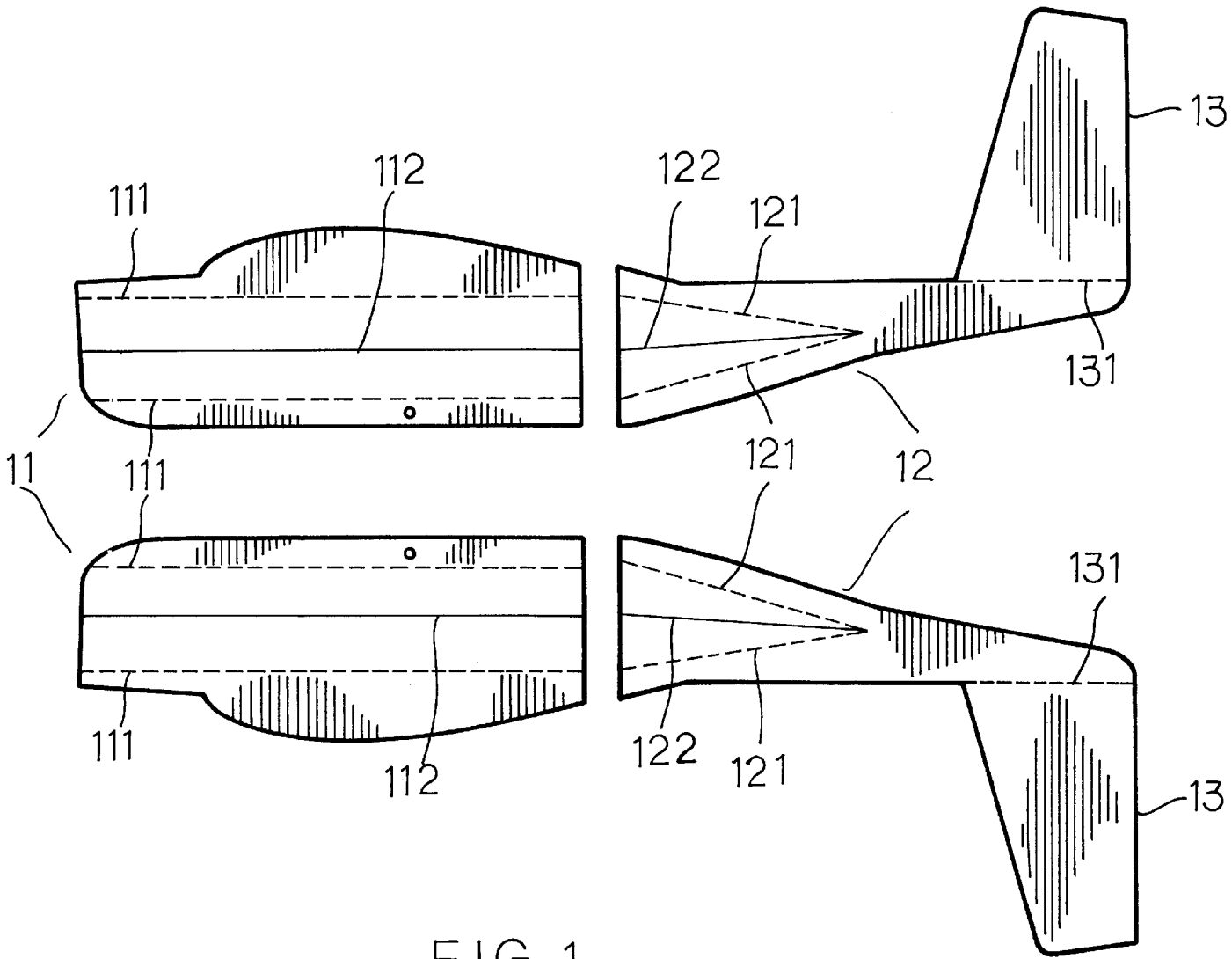
FIG. 1 is an exploded view of the flat fuselage plates of the invention.

Referring to FIG. 1, there is shown four fuselage plates (e.g., left and right front fuselage plates 11 and left and right rear fuselage plates 12) constructed in accordance with the invention. Each fuselage plate 11 has two outer creases 111 and an inner crease 112. Similarly, each fuselage plate 12 has two outer creases 121 and an inner crease 122. In front fuselage 11, inner crease 112 is parallel to outer creases 111 such that a generally straight tube is formed. In rear fuselage 12, inner and outer creases 122 and 121 are tapered toward rear to form a cone. Rear fuselage 12 and tail plane 13 are integrally formed. Only a crease 131 is seen between tail plane 13 and rear fuselage 12.

Figure 2A:
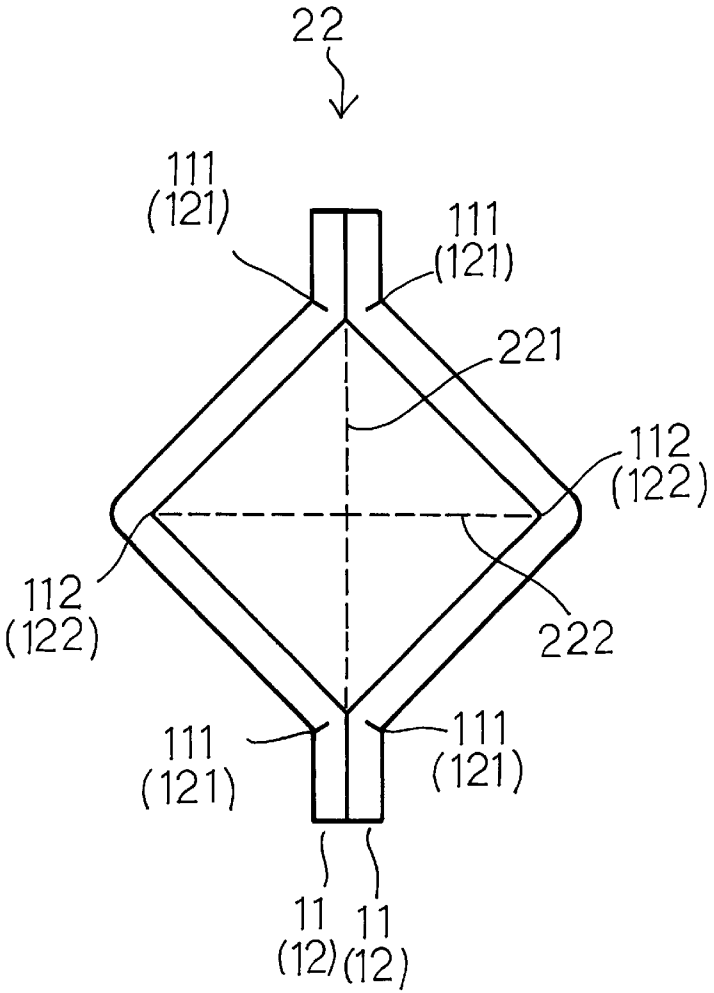
FIG. 2A is a front view of the basic form of tetrahedral fuselage folding plates by FIG. 1.
Figure 2:
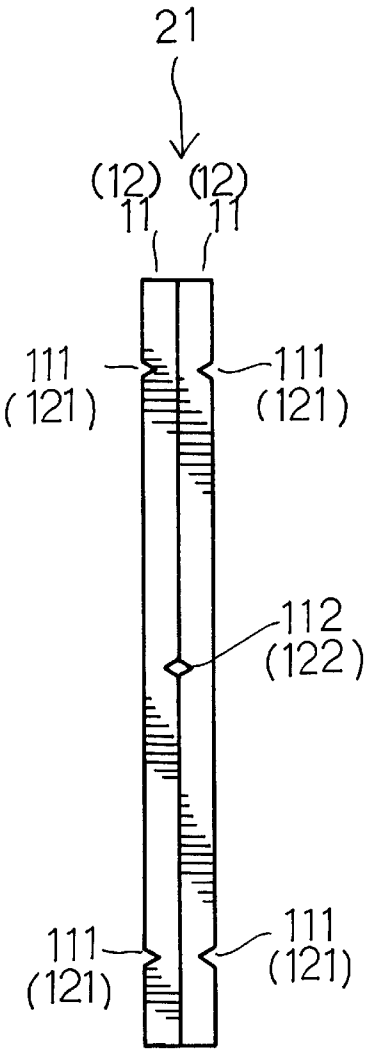
FIG. 2 is a front view of the basic form of the joined flat fuselage by FIG. 1.

Referring to FIG. 2, the diagrammatic number 21 is a basic form by joining left and right side of fuselage plates 11 (or 12) before folding work, while outer creases 111 (or 121) and inner crease 112 (or 122) of left fuselage plate are direct towards outer creases 111 (or 121) and inner crease 112 (or 122) of right fuselage plate, and the area out of outer creases 111 (or 121) is adhered together.

Referring to FIG. 2A, the diagrammatic number 22 is a basic form of tetrahedral fuselage folding plate by FIG. 2. Note that this tetragon consists of regular tetragon or rhomb in consideration of the vertical diagonal 221 is normally crossed the horizontal diagonal 222.

Figure 3:
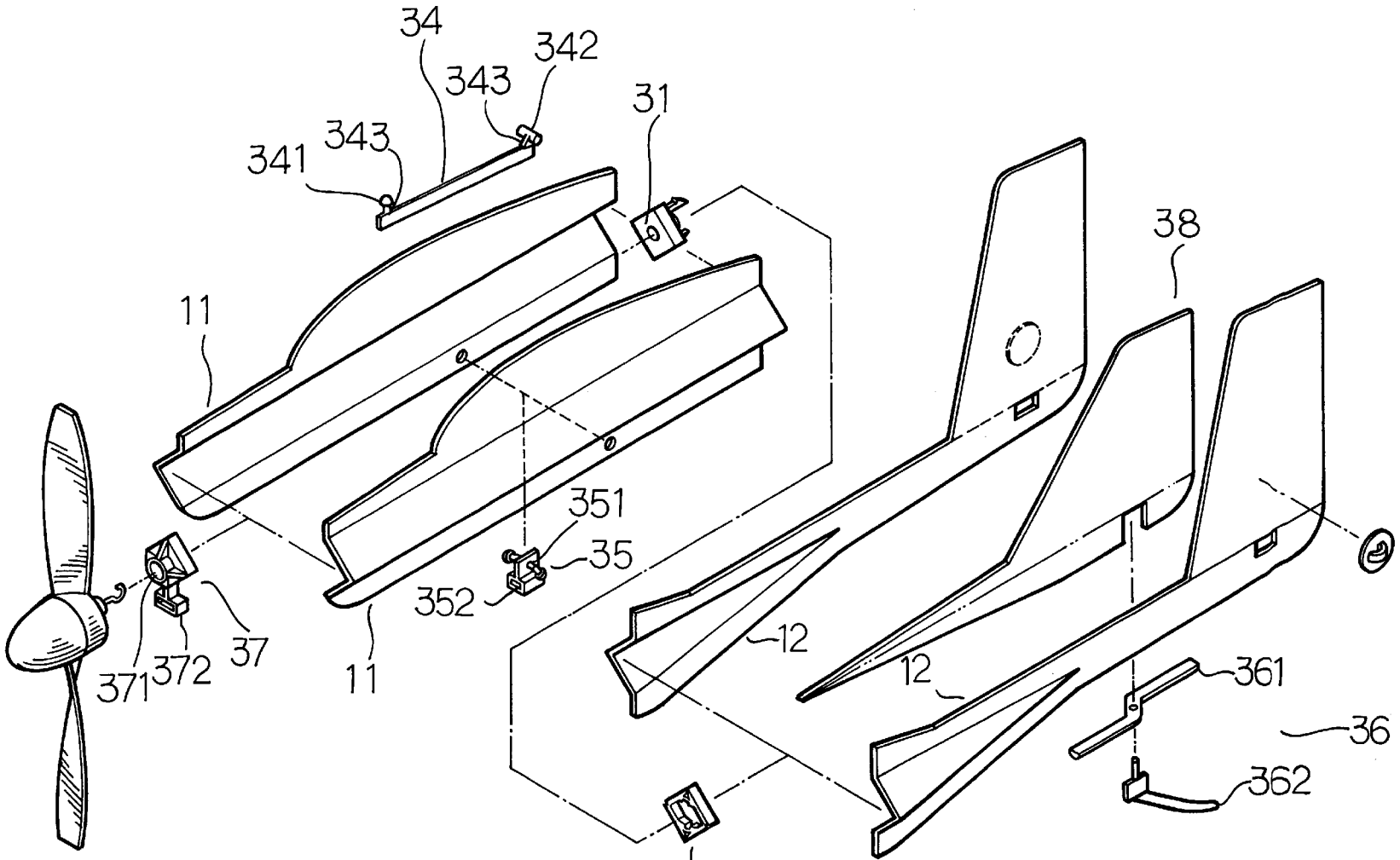
FIG. 3 is an exploded view of the fuselage components with the member parts according to the invention.

Referring to FIG. 3, an assembly of fuselages 11, 12 is detailed below. Incident shelf 34 has a leading edge button 341 and a trailing edge button 342, and two button necks 343 each abutted to buttons 341, 342. Buttons 341, 342 are made different for avoiding the inversion of wing during installation. Dihedral frame holder 35 comprises a neck 351 and a landing gear socket 352, wherein dihedral frame holder 35 and neck 351 are exposed. Tail member 36 comprises a movable tail plane holder 361 and a tail skid 362 adhered to fuselage. Head member 37 is then assembled with front fuselage 11 after folding work of fuselage has been completed. Head member 37 comprises a propeller journal bearing 371 and a front landing gear socket 372. Joint member 31 is mounted in rear of front fuselage 11. Joint member 32 is mounted in front of rear fuselage 12. These two joint members 31, 32 are detachably joined together so as to join or detach front and rear fuselages 11, 12 in a quick manner. As to tail fin 38, it is a single plate stuck between two rear fuselage plates 12. The construction of tail fin 38 is not the subject of the invention.

Figure 4:
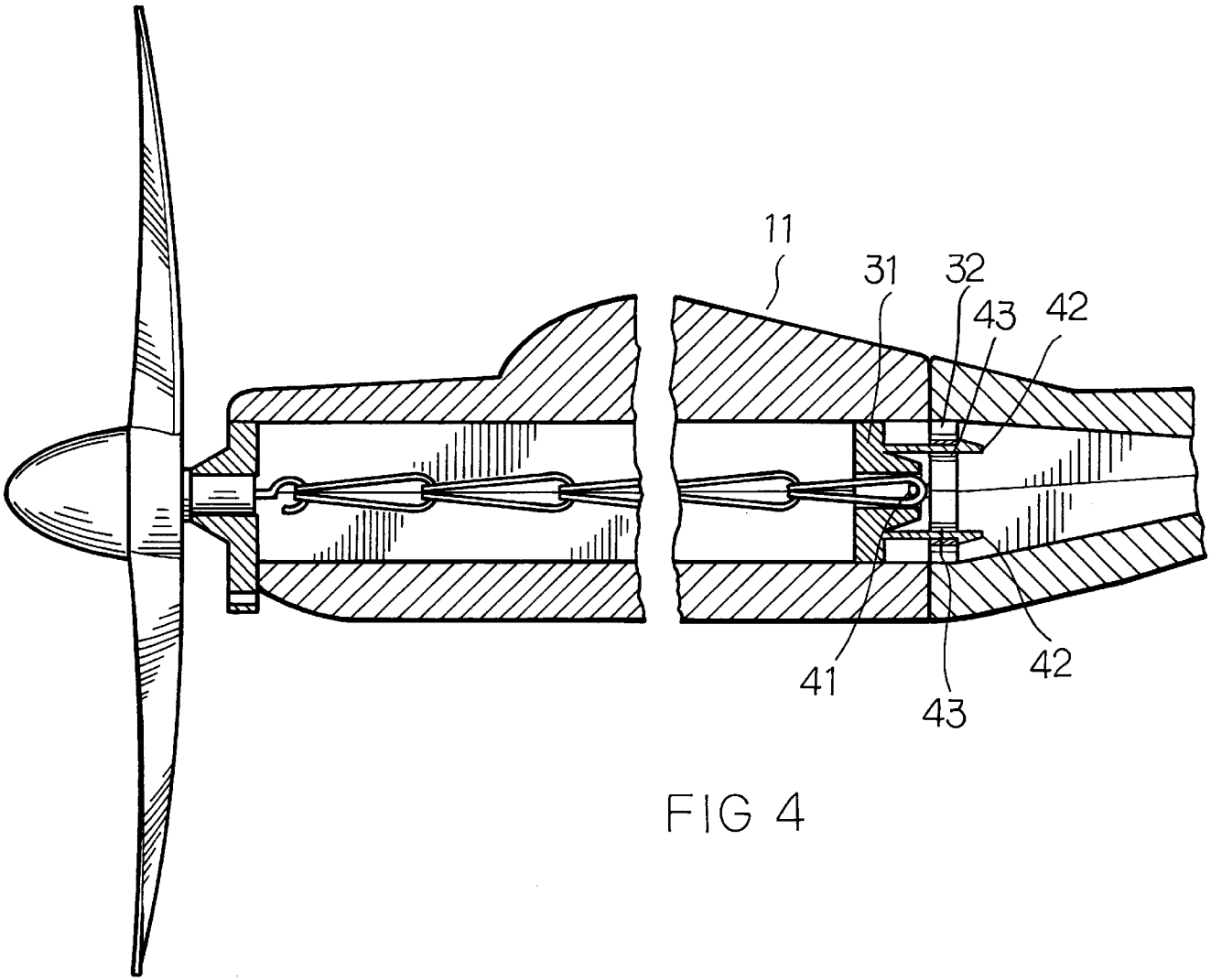
FIG. 4 is a longitudinal-sectional view of the assembled fuselage of FIG. 3.
Figure 4B:
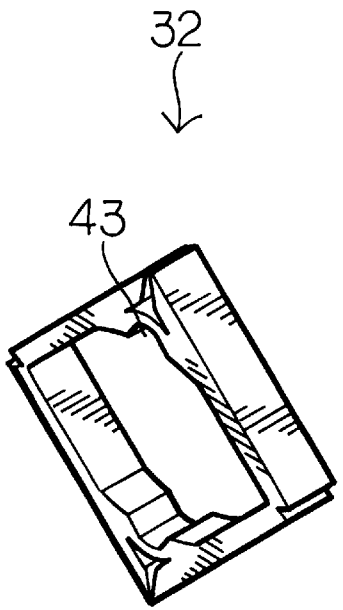
FIG. 4B is a plan view of a joint member of rear fuselage of FIG. 4.
Figure 4A:
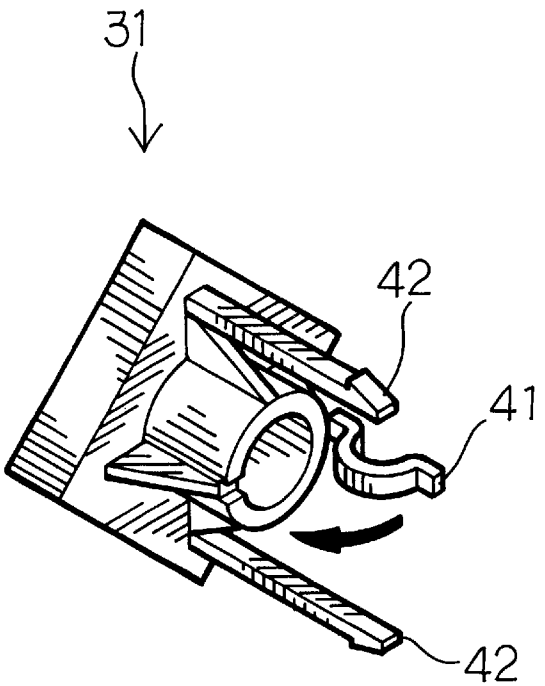
FIG. 4A is a perspective view of a joint member of front fuselage of FIG. 4.

Referring to FIG. 4, there is shown an assembled fuselage with propeller, rubber bands and rubber hook 41 in the joint member 31. Referring to FIGS. 4A and 4B, two joint hooks 42 are provided on the top and bottom of joint member 31 respectively. Joint hooks 42 cooperate with escapement 43 in the joint member wherein the wedge portions of joint hooks 42 extend beyond escapement 43 so as to flexibly-secure together.

Figure 5:
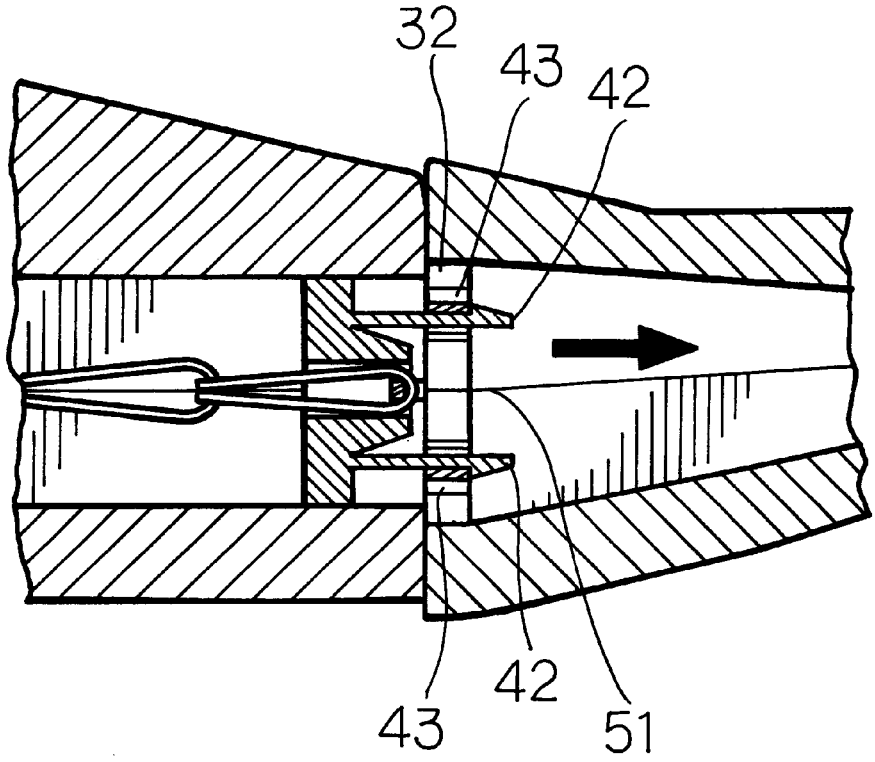
FIG. 5 is an enlarged longitudinal section view of the disengage form of FIG. 4.
Figure 5A:
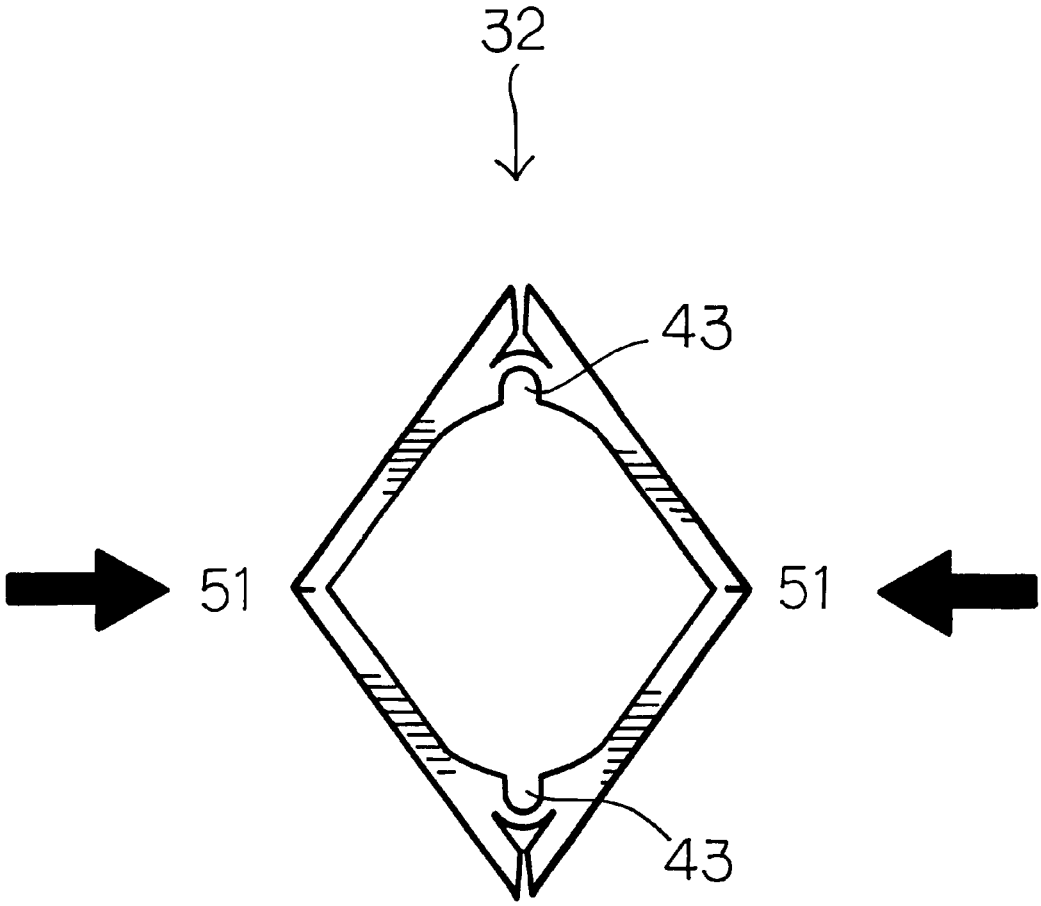
FIG. 5A is a schematic plan view of a joint member of rear fuselage of FIG. 4.

Referring to FIGS. 5 and 5A, a description of disassembly of the two-part fuselage is detailed below. A thin arcuate escapement 43 is connected between top and bottom corners of joint member 32 of rear fuselage. In disassembly, press the left and right sides 51 of joint member 32 toward each other as indicated by arrows. This will increase the distance between the top and bottom corners, i.e., increase the distance between escapement 43. As a result, two joint hooks 42 disengage from escapement 43.

Figure 6:
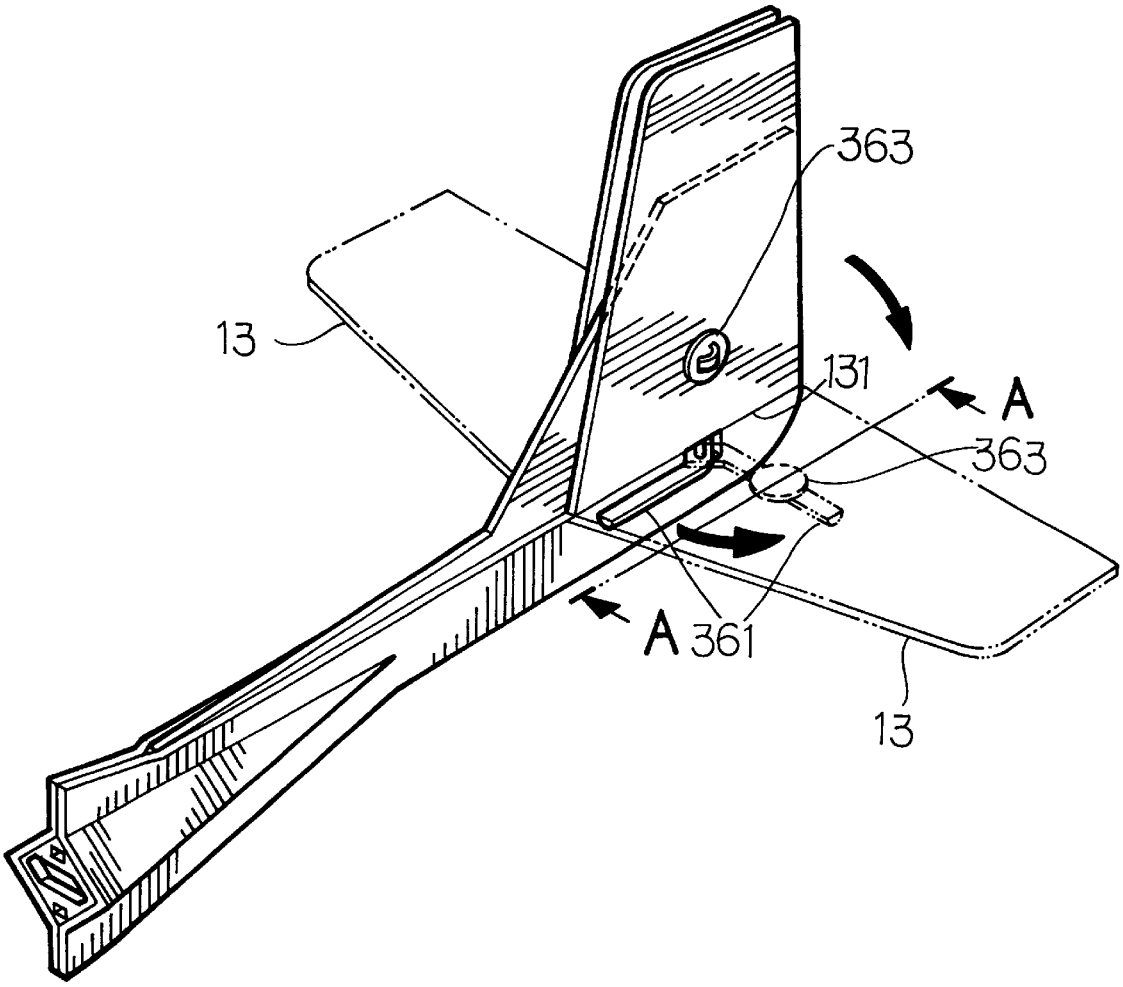
FIG. 6 is a perspective view of the assembled tail plane of FIG. 3.
Figure 6A:
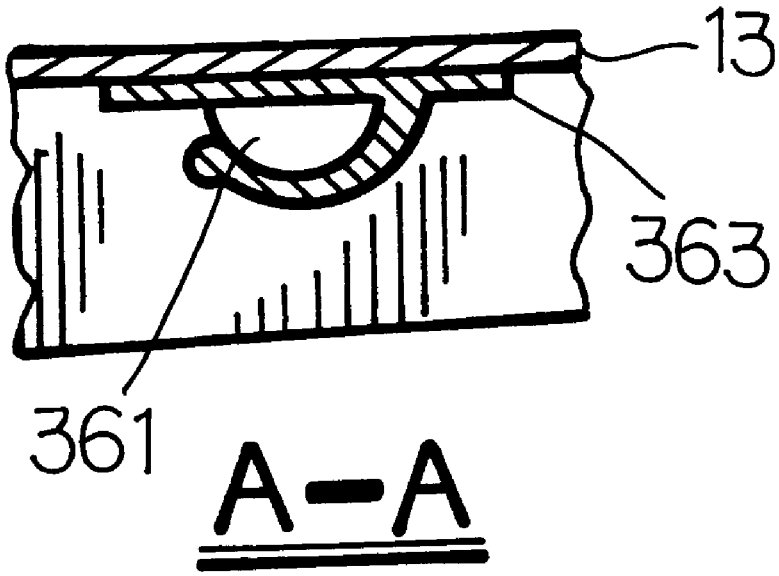
FIG. 6A is a cross-sectional view taken along line A—A of FIG. 6 showing the assembly of tail plane folding plate.

Referring to FIGS. 6 and 6A, tail planes 13 are formed by unfolding from crease 131. Tail plane holder 361 is hooked to tail plane hook 363, this completes a horizontal stabilizer.

Figure 7:
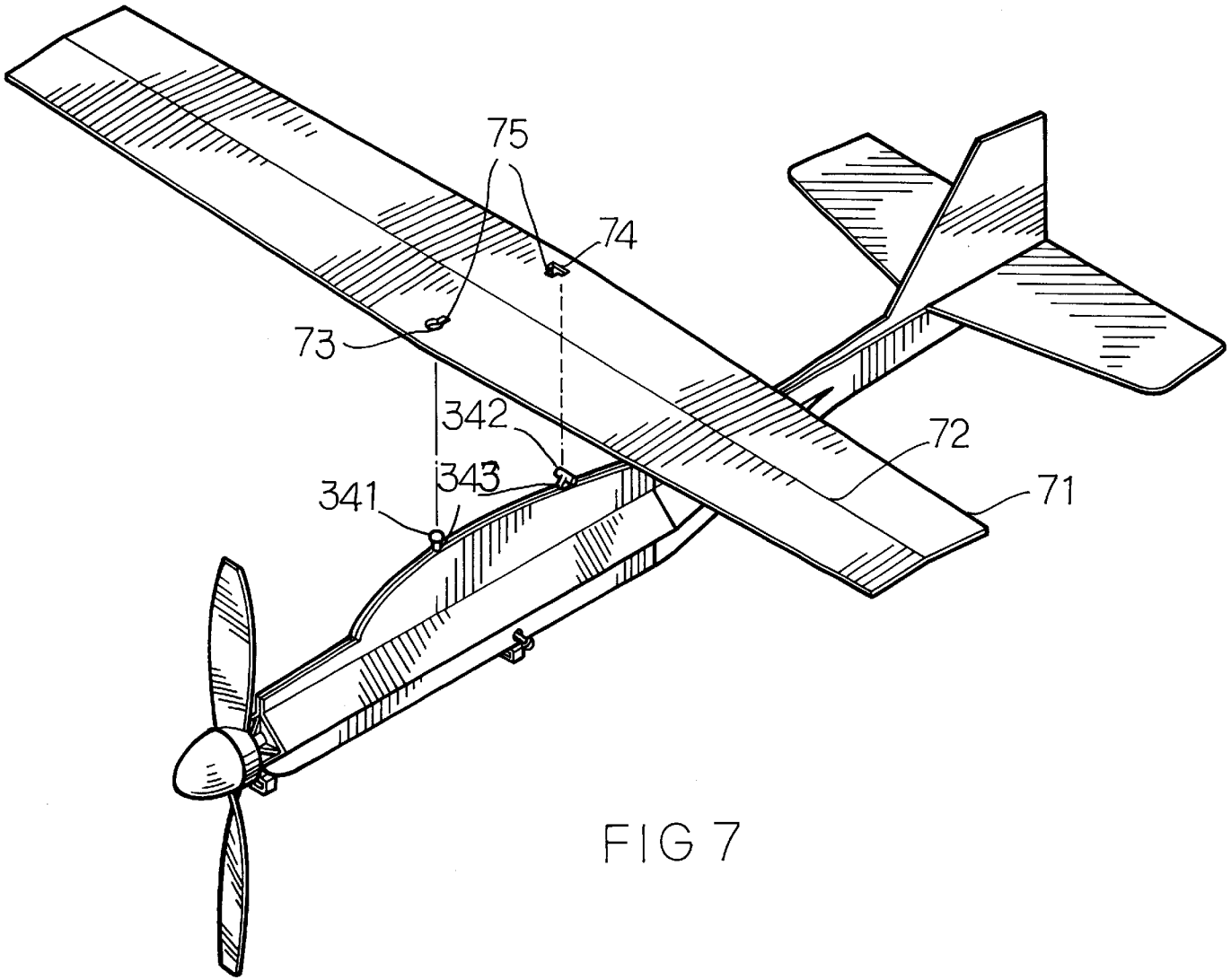
FIG. 7 is a perspective view schematically showing the assembly of wing to the fuselage of the invention.

Referring to FIG. 7, wing 71 has a crease 72 along its length to fold up an aerofoil profile for lift. A leading edge button hole 73 and a trailing edge button hole 74 formed on the center of wing 71 for permitting leading edge button 341 and trailing edge button 342 to insert and secure therein respectively. Button slits 75 of button holes 73 and 74 cling into button necks 343 of buttons 341 and 342. This wing and fuselage joining is stable in the longitudinal direction, while not stable in the lateral direction.

Figure 8:
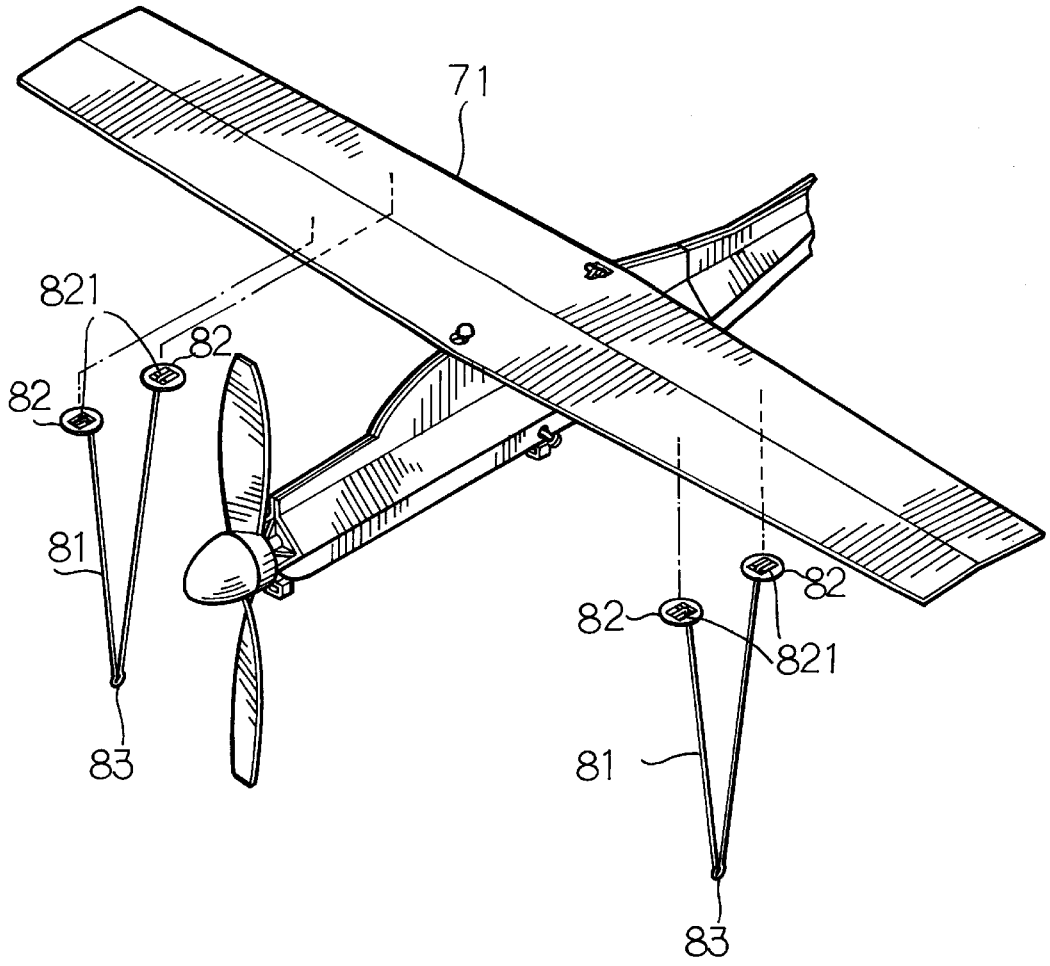
FIG. 8 is a perspective view showing the assembly of V-shaped dihedral frame of the invention.

Referring to FIG. 8, a pair of V-shaped dihedral frames 81 are provided to enhance the stability of wing 71 in the lateral direction. V-shaped dihedral frame 81 is formed of a thin metal wire comprising two sticking pieces 82 each having a groove 821, and a dihedral framing ring 83 formed at the bottom of the dihedral frame 81, four sticking pieces 82 are adhered to the wing 71.

Figure 9:
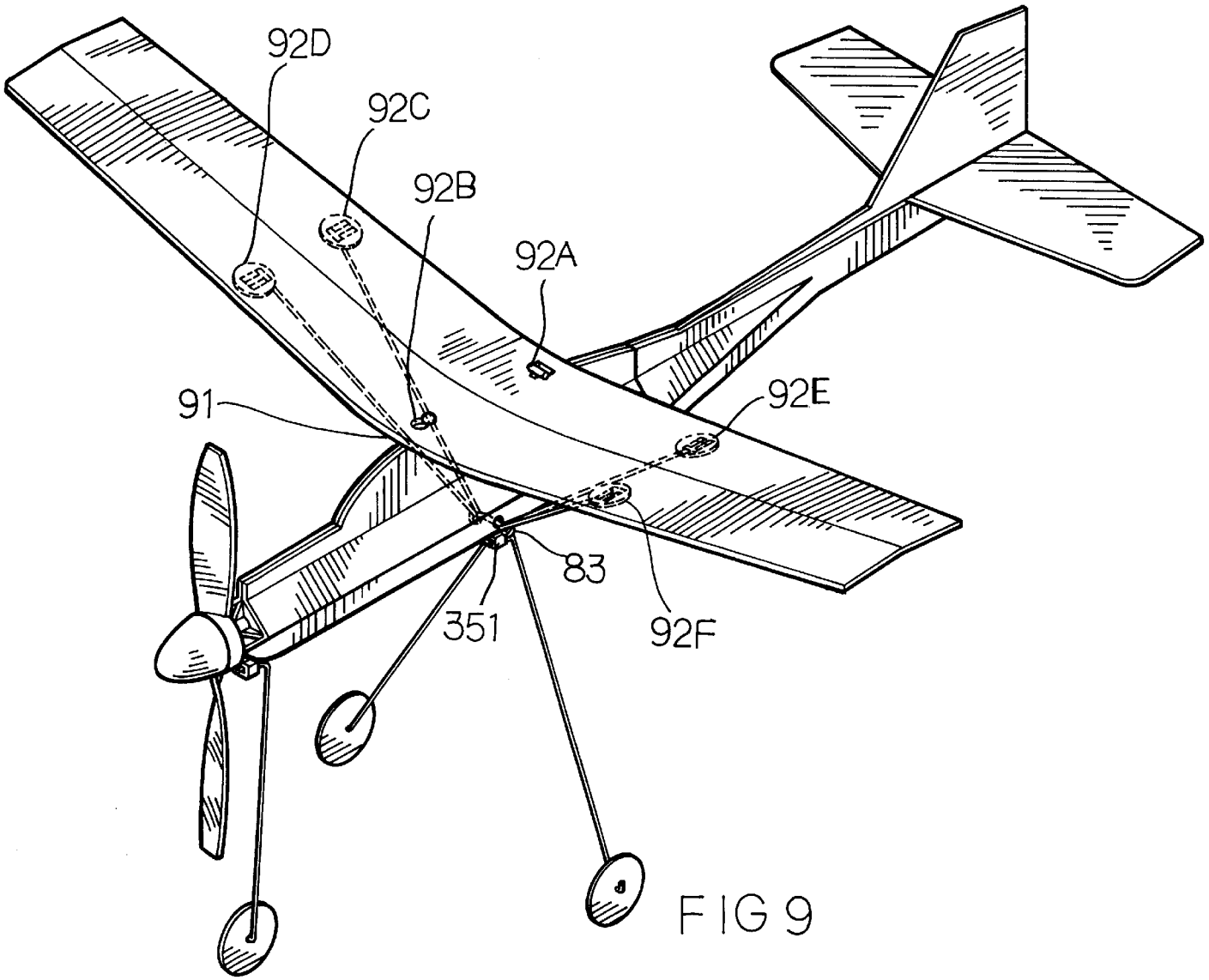
FIG. 9 is a perspective view showing the assembly of bowed dihedral by six support points.
Figure 10:
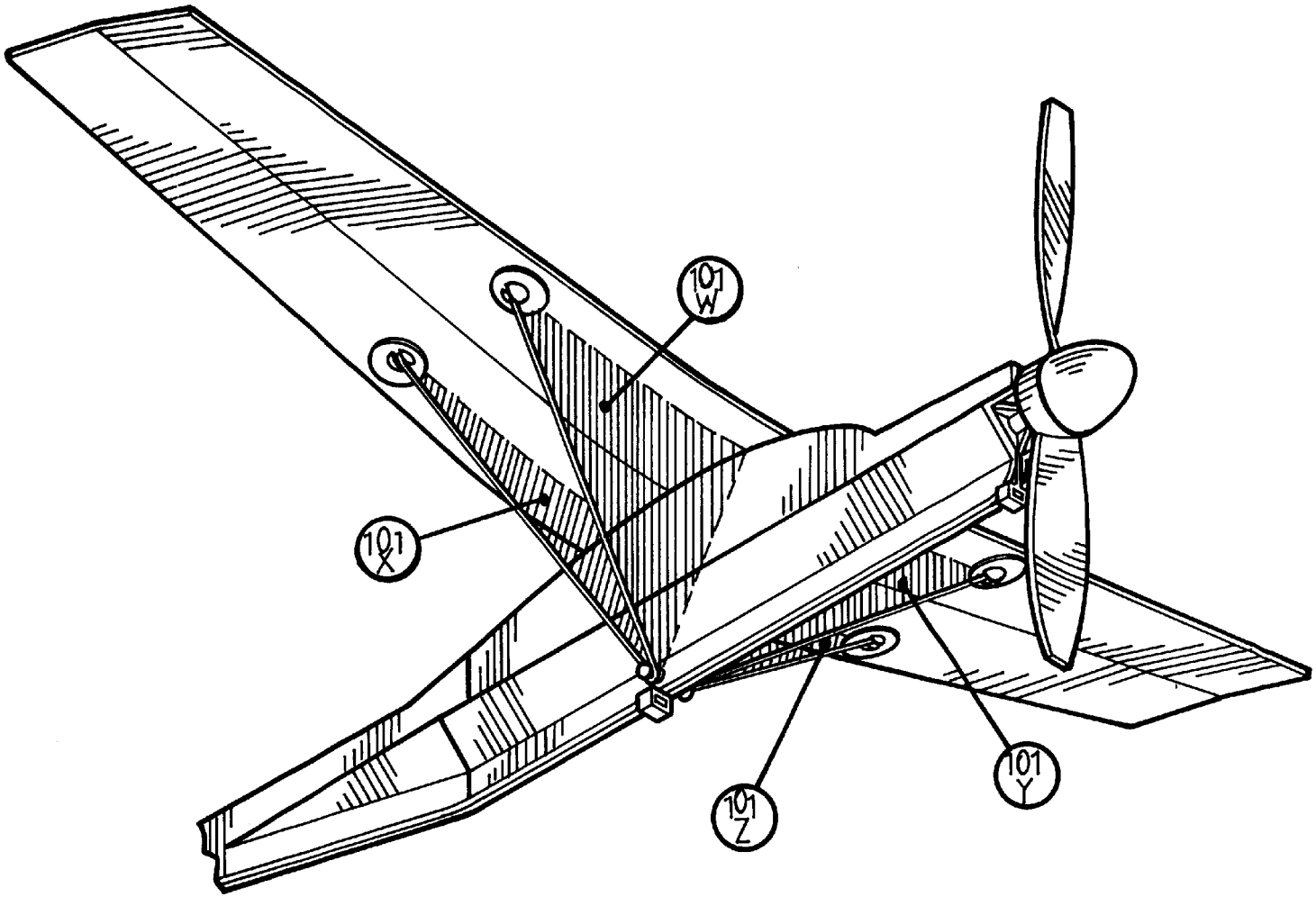
FIG. 10 is a perspective view showing the features of four trilateral structures between fuselage and wing of the invention.

Referring to FIGS. 9 and 10, dihedral framing rings 83 is clung to neck 351 of dihedral frame holders 35. As such, wing 71 are supported in six points 92A to 92F and secured to bowed dihedral 91 of fuselage (FIG. 9). As shown in FIG. 10, four trilateral structures 101W, 101X, 101Y, and 101Z are formed, provide a competent strength of structure.

The invention is capable of finishing assembly in about 10 seconds without requiring any glue, tool, skill or aerodynamics knowledge. This is also true for detaching the same.

While the invention herein disclosed has been described by means of specific embodiments, numerous modifications and variations could be made thereto by those skilled in the art without departing from the scope and spirit of the invention set forth in the claims.

What is claimed is:

1. A semi-scale toy plane comprising:

(a) a fuselage including a front fuselage and a rear fuselage each formed of regular tetragonal or rhombic folding plates;

(b) a tail plane integrally formed with the rear fuselage which are spaced into a plurality of different sections by a plurality of creases;

(c) a wing secured to the front fuselage through six supporting points; said wing being a bowed dihedral framing; and (d) four trilateral structures; each having a V shaped dihedral frame and being installed between the front fuselage and the wing; each side of the fuselage having two trilateral structure.

2. The semi-scale toy plane of claim 1, wherein said fuselages is formed by a plurality of tetrahedral folding plates.

3. The semi-scale toy plane of claim 2, wherein each of said tetrahedral folding plate of the front fuselage is formed as a straight tube, each of the tetrahedral folding plates of the rear fuselage is tapered toward the rear as a cone, the front and the rear fuselages are detachably secured by a pair of joint members with joint.

4. The semi-scale toy plane of claim 1, wherein both sides of the tail plane are integrally formed with the rear fuselage, and each divided by a tail crease such that the expanded tail planes are secured by a movable tail plane holder for forming a horizontal stabilizer.

5. The semi-scale toy plane of claim 1, wherein the V-shaped dihedral frame is formed of a thin metal wire, a dihedral framing ring formed at a bottom the V-shaped dihedral frame and a movable sticking piece positioned at a tip point of The V-shaped dihedral frame.

* * * * *